US006230726B1

(12) United States Patent
Dell

(10) Patent No.: US 6,230,726 B1
(45) Date of Patent: May 15, 2001

(54) WALKING AID

(76) Inventor: David Michael Dell, 10 O'Conner Drive, Pukekohe, 1800 (NZ)

( * ) Notice: Subject to any disclaimer, the term of this patent is extended or adjusted under 35 U.S.C. 154(b) by 0 days.

(21) Appl. No.: 09/407,289

(22) Filed: Sep. 29, 1999

(30) Foreign Application Priority Data

Oct. 2, 1998 (NZ) ..... 332126
Feb. 23, 1999 (NZ) ..... 334303

(51) Int. Cl.[7] ..... A45B 9/04

(52) U.S. Cl. ..... 135/65; 135/77; 135/75; 294/19.1

(58) Field of Search ..... 135/66, 69, 75, 135/77, 86; 294/19.1, 19.2

(56) References Cited

U.S. PATENT DOCUMENTS 3,289,685 * 12/1966 Parker ..... 135/77 X
4,510,957 * 4/1985 Frank ..... 135/86 X
4,938,516 * 7/1990 Temple ..... 294/19.1 X
4,947,882 * 8/1990 Levasseur ..... 135/77 X
6,058,953 * 5/2000 Stefanelli ..... 135/75 X

* cited by examiner

*Primary Examiner*—Peter M. Cuomo
*Assistant Examiner*—Michael J. Fisher

(57) ABSTRACT

A walking aid (1) for attachment to a leg (2) of a walking stick or crutch, comprises a foot plate (3), and an attachment device in the form of a rubber molding (6) for attaching the foot plate (3) to the leg (2). The foot plate (3) and the attachment device (6) are constructed and arranged such that in use with the leg (2) attached to the foot plate (3), a portion (8) of a peripheral edge (5) of the foot plate (3) protrudes a sufficient amount (l) to enable the leg (2) when resting on the ground to be tilted to a substantially upright position by appropriate application of foot pressure to the portion (8), thereby enabling a person with disability to pick up a dropped walking stick or crutch.

15 Claims, 2 Drawing Sheets

WALKING AID

BACKGROUND OF THE INVENTION

The present invention relates to walking aids which can be attached to walking sticks and crutches, and to walking sticks and crutches with the walking aids attached thereto.

Persons with spinal disability value the assistance of walking aids on stairs, inclines and the like. The same disability may prevent them from bending to reach the ground and retrieve articles such as clothing, tools and keys, or to pick up a walking stick or crutch if dropped.

Walking on cambered surfaces such as roads and footpaths carries extra risk, and oil contamination increases the risk. Outpatient Departments of hospitals usually provide only the cheapest and most limited aids.

SUMMARY OF THE INVENTION

It is an object of the present invention to provide a walking aid for attachment to a leg of a walking stick or crutch which addresses the above problems.

According to a first aspect of the present invention there is provided a walking aid for attachment to a leg of a walking stick or crutch, comprising: a foot member having a peripheral edge defining a contact region for contact with the ground; and an attachment device for attaching the foot member to the leg, wherein the foot member and the attachment device are constructed and arranged such that in use with a leg attached to the foot member by the attachment device, a portion of the peripheral edge protrudes a sufficient amount to enable the leg when resting on the ground to be tilted to a substantially upright position by appropriate application of foot pressure to the portion of the peripheral edge.

With such a construction, then when fitted to the leg of a walking stick or crutch, the contact area with the ground is increased due to the protruding peripheral edge, thus improving grip and reducing the possibility of slipping. Moreover, the ability to be able to tilt a walking stick or crutch fitted with the walking aid to an upright position by application of foot pressure to the peripheral edge, is of benefit to a person who is unable to bend to reach the ground to pick up the walking stick or crutch if dropped.

Furthermore, with a suitable size and shape for the foot member, a walking stick or crutch fitted with the walking aid can be left standing upright on the foot by itself, which is an added benefit.

Preferably the amount of protrusion of the portion of the peripheral edge is greater than 10 mm to ensure suitable application of foot pressure.

The attachment device may comprise any suitable means whereby the foot member can be attached to the leg.

For example this may comprise a socket member formed with a socket for accommodating an end of the leg. The socket member may be formed integral with the foot member, and may comprise for example a socket formed in the foot member such as in the case of an integral molding, or a special purpose socket member bonded to a surface of the foot member.

Alternatively the socket member may be provided separate from the foot member and formed with a base which in use abuts against an upper surface of the foot member, and there may be provided a connection device for detachably connecting the socket member at the base to the upper surface of the foot member.

The base may be convex so as to assist articulation against the upper surface of the foot member. By having such articulation, cambers and inclines can be accommodated as the user leans into them to keep balance.

The connection device may be any suitable device whereby the socket member can be detachably connected to the foot member. For example this may comprise a rod member spanning between the socket member and a first aperture in the foot member and a tensioning device for tensioning the rod member so that in use the base is clamped against the upper surface of the foot member.

Preferably the rod member has a head portion encapsulated in the socket member and a threaded portion protruding therefrom and extending through the aperture, and the tensioning device comprises a nut or a threaded portion in the first aperture for threading onto the threaded portion of the rod member to tension the rod member and hold the resilient attachment member tightly against the foot member.

With such a construction, the socket member can be easily removed from the foot member for replacement of either member as required.

The foot member may be of any suitable form depending on requirements, provided the construction is such that a portion of the peripheral edge protrudes a sufficient amount to enable a leg fitted into the socket and resting on the ground to be tilted to a substantially upright position by appropriate application of foot pressure to the portion of the peripheral edge.

In order to enhance use on rough surfaces, a lower surface of the foot member may be such as to make multiple contacts on the ground. For example the foot member may have three, four or more ground contactors. These may be arranged in a ring.

The construction may be such that the foot member is of a generally rectangular shape in plan view, and the first aperture is disposed substantially centrally on the foot member, and there is further provided a second aperture disposed a predetermined distance in a longitudinal axis direction from the first aperture, for optionally accommodating the rod member when the walking aid is used for attachment to a leg of a crutch.

By having a second aperture at a different location to the first aperture, then the foot member can be attached at a more suitable location depending on whether the aid is used for a walking stick or crutch.

The socket member may be made from a resilient material such as rubber so that in use articulation is enhanced between a leg fitted into the socket and the foot member.

Furthermore, the socket member may be further provided with a waisted portion disposed between a bottom end of the socket and the base such that in use articulation is further enhanced between a leg fitted into the socket and the foot member.

According to another aspect of the present invention there is provided a walking aid substantially as described for the first aspect, wherein the attachment device comprises a fastener for connecting the foot member to an end of the leg, instead of the above described socket member. In this case the foot member may be fixed to the end of the leg with no flexibility therebetween.

To enhance articulation between the leg and the foot member, the attachment device may further comprise a resilient spacer which separates the foot member from the end of the leg.

The fastener may comprises a rod member adapted for connection to the leg, a first aperture formed in the foot member for accommodating the rod member and a tensioning device for optionally tensioning the rod member when fitted between the leg and the foot member. In this case the resilient spacer may be formed with a through hole for taking the rod member. Moreover the tensioning device may be suitable tensioned to compress the spacer lightly between the foot member and the end of the leg to a variable extend to suit the users preference.

Again as for the above mentioned case of the walking aid comprising the socket member, the foot member may be of a generally rectangular shape in plan view, and the first aperture may be disposed substantially centrally on the foot member, and there may be further provided a second aperture disposed a predetermined distance in a longitudinal axis direction from the first aperture, for optionally accommodating the rod member when the walking aid is used for attachment to a leg of a crutch.

Any suitable material may be used for the walking aid as described above depending on requirements and costs and the like. For example the walking aid may be molded in polymer or its mechanical equivalent. In the case of the walking aid where the socket member is formed integral with the foot member, then the two parts may be molded as one. Reinforcing may be provided in the form of inserts, or ribbing as required.

According to a third aspect of the present invention there is provided a walking stick or crutch fitted with a walking aid substantially as described above fitted to a leg thereof.

The leg may be a standard leg or may comprise a length adjusting device for adjusting the length thereof. The length adjusting device may comprise a telescoping extension at a lower and thereof. Conveniently locking of the telescoping extension may be by twisting or pinning.

A support on an end of the leg of the walking stick or crutch opposite from the walking aid end may be a D-handle, a T-handle or an L-handle or an equivalent to place the leg in line with the arm or armpit during use.

The walking stick or crutch may further comprise a retrieval device operable from a handle of the walking stick or crutch against the foot member. Operation of the retrieval device may be by a linkage or cable. Moreover, a magnet may be attached to the foot member, for use in retrieving metallic objects.

By providing a retrieval device and magnet, the walking aid is of further benefit to disabled persons, who have difficulty in bending.

Further aspects and advantages of the present invention will become apparent from the following description given in conjunction with the accompanying drawings in which:

DETAILED DESCRIPTION OF THE INVENTION

Figure 1:
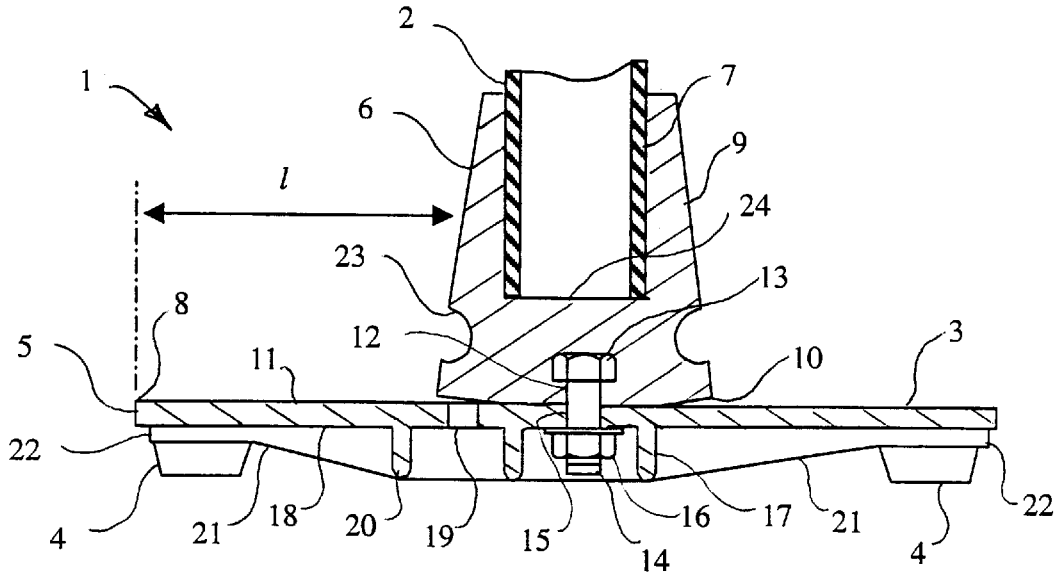
FIG. 1 is a cross sectioned side view of a walking aid according to an embodiment of the present invention.
Figure 2:
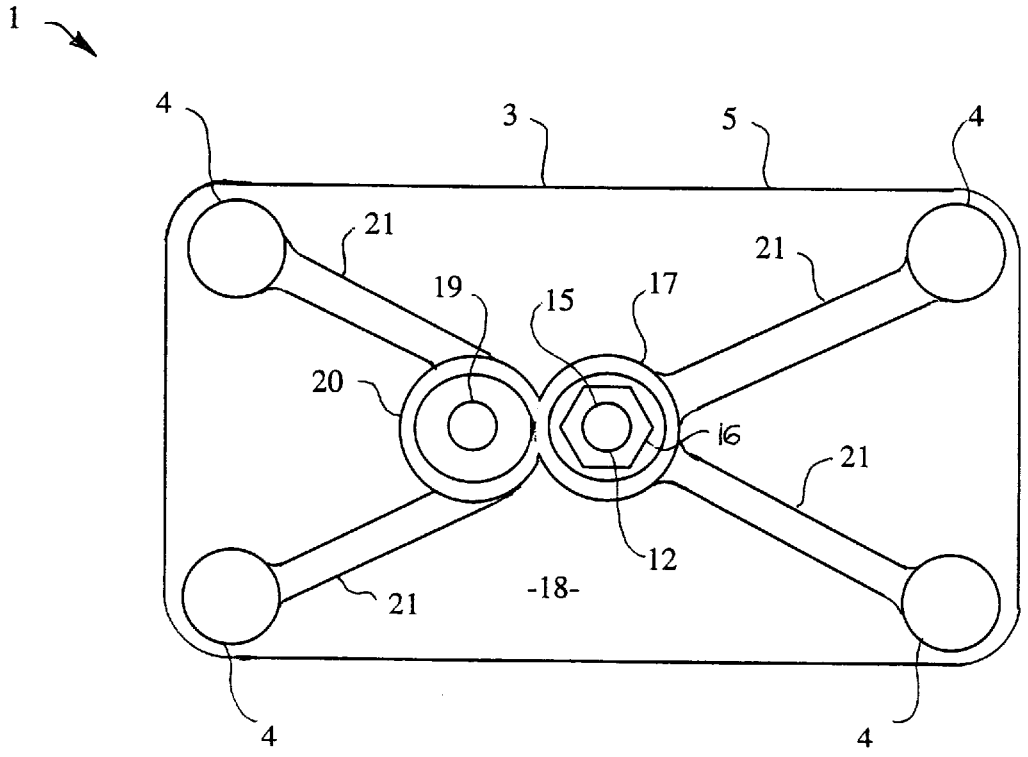
FIG. 2 is an underneath plan view of FIG. 1.

Referring now to FIG. 1 and FIG. 2, a walking aid generally indicated by arrow 1 according to a first embodiment of the present invention for attachment to a round aluminum shaft 2 constituting the leg of a walking stick or crutch comprises a molded nylon foot plate 3 having four feet 4 and having a peripheral edge 5 defining a contact region for contact with the ground, and a socket member in the form of a frusto-conical rubber molding 6 formed with a socket 7 for accommodating an end of the leg 2 by push fitting thereinto. As shown in FIGS. 1 and 2, the foot plate 3 and the molding 6 are constructed and arranged such that in use with the leg 2 attached to the foot plate 3 by insertion into the socket 7, a portion 8 of the peripheral edge 5 protrudes a sufficient amount l to enable the leg 2 when resting on the ground to be tilted to a substantially upright position by appropriate application of foot pressure to the portion 8 of the peripheral edge 5. With the present embodiment, the dimension of the foot plate is 120 mm long by 90 mm wide with the length l approximately 32 mm for each end and 16 mm for each side. While it was possible to upright a walking stick fitted to the walking aid 1 with an amount of protrusion l as little as 10 mm, the greater amount of protrusion ensured suitable application of foot pressure.

The molding 6 has a tapered part 9 surrounding the socket 7 and a convex base 10. Having the convex base 10 assists articulation against an upper surface 11 of the foot plate 3. Connection of the molding 6 to the foot plate 3 involves a bolt 12 with a head 13 encapsulated in the molding 6 and with a threaded portion 14 protruding therefrom and spanning between the molding 6 and an aperture 15 in the foot plate 3, and a nut 16 for threading onto the threaded portion 14 to tension the bolt 12 and hold the convex base 10 of the molding 6 tightly clamped against the upper surface 11 of the foot plate 3. While not shown in the figures, the arrangement may of course alternatively involve a nut encapsulated in the molding 6 and a screw threaded into the nut from beneath. Moreover a washer may be provided under the bolt head to increase retention.

The nut 16 is protected by a guard ring 17 formed on a lower surface 18 of the foot plate 3 about 10 mm deep. As shown in FIG. 2, the foot plate 3 is of a generally rectangular shape in plan view (120 mm by 90 mm), and the aperture 15 is disposed substantially centrally on the foot plate 3. Moreover a companion aperture 19 is offset 15 mm from the aperture 15 for optionally accommodating the bolt 12 when the walking aid 1 is used for attachment to a leg of a crutch. The offset of 15 mm was found to give the best "feel" in use. Here the center aperture 15 is used with walking sticks, while the offset aperture 19 is used with crutches, however the opposite is also possible if desired.

The aperture 19 also has a guard ring 20 which adjoins the ring 17. Integral ribs 21 extend from the rings 17 and 20 to four raised corner pads 22 upon which the four feet 4 are clamped by fasteners (not shown).

As shown in FIG. 1, the molding 6 is further provided with a waisted portion in the form of a semi circular sectioned circumferential groove 23 disposed between a bottom end 24 of the socket 7 and the base 10 such that in use articulation is further enhanced between the leg 2 fitted into the socket 7 and the foot plate 3.

Figure 4:
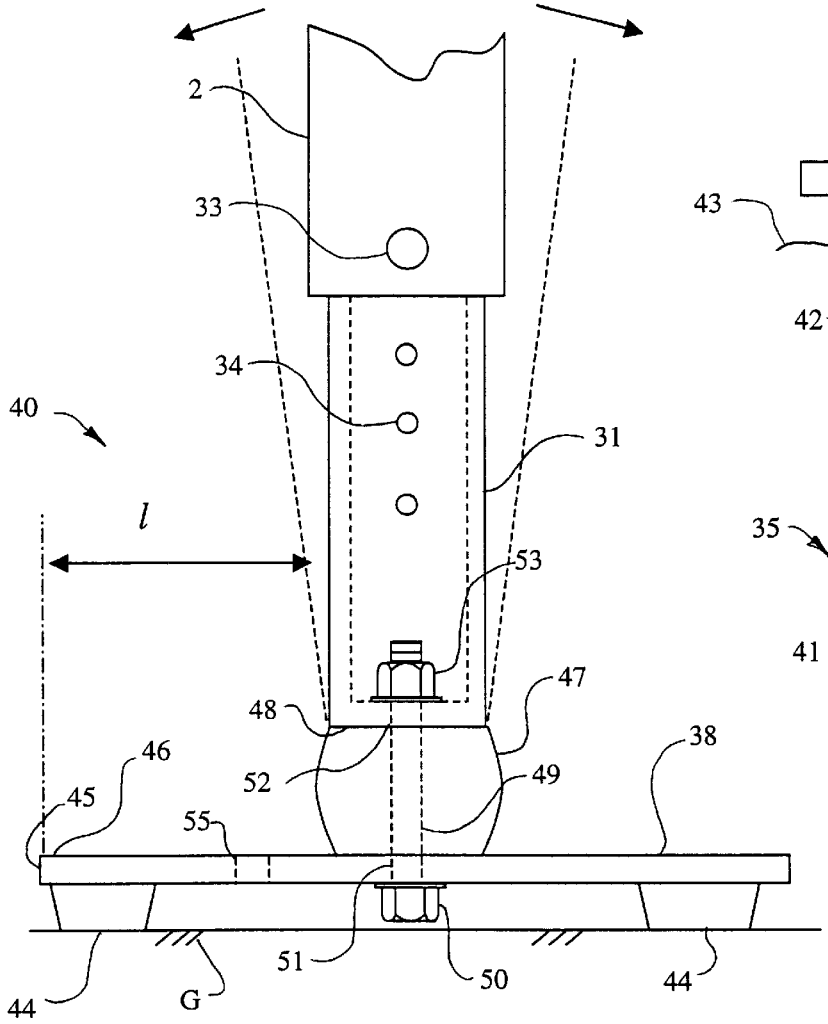
FIG. 4 is a side view of the walking aid of FIG. 3 but with a flexible foot.
Figure 3:
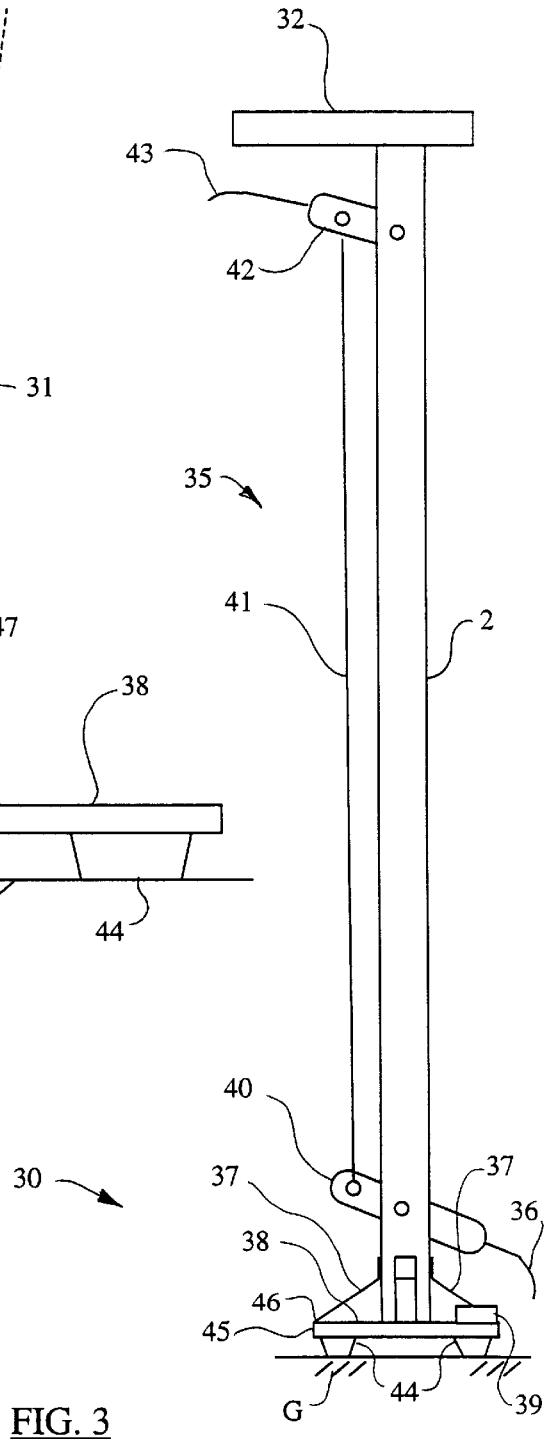
FIG. 3 is a side view of a walking aid with a fixed foot according to another embodiment of the present invention fitted to a walking stick.

FIG. 3 shows a side view of a walking aid with a fixed foot according to another embodiment of the present invention generally indicated by arrow 30, fitted to a leg 2 of a walking stick, while FIG. 4 shows details of a telescoping arrangement for the leg 2 of FIG. 3, but fitted with another walking aid generally indicated by arrow 40 having a flexible foot.

In FIG. 3, and FIG. 4, the leg 2 is made of aluminum square tube. The leg 2 receives a telescoping extension 31 at the lower end (not shown in FIG. 3) and has a handle 32 at its upper end. The telescoping extension 31 is locked at an appropriate length by inserting a pin 33 through the leg 2 and through one of several apertures 34 passing through the extension 31. The handle 32 is arranged so as to place the leg 2 in line with the arm or armpit during use.

The leg 2 is further fitted with a retrieval device 35 comprising a tilting grab 36 which closes on a forward bracket 37 of a foot plate 38. A magnet 39 is attached to the same bracket 37 for retrieving metallic objects. The tilting grab 36 is operable from the handle 32 against the forward bracket 37, by means of a linkage comprising a lower pivot arm 40, a link rod 41, an upper pivot handle 42 and a lever 43.

In FIG. 3 and FIG. 4, the foot plate 38 is made of an aluminum plate 90 mm by 120 mm fitted with four rubber feet 44. In FIG. 3 the foot plate 38 is attached to the leg 2 by means of four triangular brackets 37, which are either welded, bolted and or bonded to the leg 2, this giving a rigid attachment. In FIG. 4, the foot plate 38 is attached by an alternative attachment device described later.

As shown in FIGS. 3 and 4, the foot plate 38 has a peripheral edge 45 defining a contact region for contact with the ground G by the rubber feet 44, and a portion 46 of the peripheral edge 45 protrudes a sufficient amount l to enable the leg 2 when resting on the ground G to be tilted to a substantially upright position by appropriate application of foot pressure to the portion 46 of the peripheral edge 45. Here the length l is 32 mm for each end and 16 mm for each side.

With the attachment device as shown in FIG. 4, the attachment of the foot plate 38 further comprises a resilient spacer 47 which separates the foot plate 38 from an end 48 of the telescoping extension 31 of the leg 2, and which is formed with a through hole 49. In this case fastening of the foot plate 38 to the leg 2 involves a bolt 50 which is inserted through a hole 51 in the foot plate 38, the hole 49 in the spacer 47 and a hole 52 in the end of the extension 31, and a nut 53 for optionally tensioning the bolt 50 when fitted between the extension 31 and the foot plate 38 with the spacer 47 therebetween. Hence the spacer 47 can be lightly pressed between the foot plate 38 and the end 48 of the extension 31 to a variable extent to give the desired articulation between the leg 2 and the foot plate 38 as indicated by the dotted lines and arrows in FIG. 4.

The foot plate 38 can thus execute pitching motion but allows rolling motion for passage over a camber.

In FIG. 4, tensioning of the bolt 50 is by means of the nut 53. However, instead of the nut 53 it is possible to have a threaded hole in the end 48 of the extension 31, with the bolt 50 threaded thereinto. Moreover, as shown in FIG. 4, an offset hole 55 is offset 15 mm from the hole 51 for optionally accommodating the bolt 50 when the walking aid 40 is used for attachment to a leg of a crutch.

The walking aid of the above described embodiments with the foot plate of 90 mm by 120 mm enables a walking stick or crutch to be stood upright on the foot plate in a parked position.

Moreover, if the walking stick or crutch falls over it can be retrieved without the user needing to bend down, by applying a tilting pressure of the user's foot to the foot plate at the edge portion 46 (either the side edge or the end edge).

Aspects of the present invention have been described by way of example only and it should be appreciated that modifications and additions may be made thereto without departing from the scope of the invention as defined by the appended claims.

What I claim as my invention is:

1. A walking aid for attachment to a leg of a walking stick or crutch, comprising a foot member having a peripheral edge defining a contact region for contact with the ground, a socket member for attaching said foot member to said leg, and connection means for detachably connecting said socket member to an upper surface of said foot member, said foot member and said socket member being constructed and arranged such that in use with said foot member attached to said socket member by said connection means and a leg attached to said socket member, a portion of said peripheral edge protrudes a sufficient amount from said socket member to enable said leg when resting on the ground to be tilted to a substantially upright position by appropriate application of foot pressure to said portion of said peripheral edge, wherein said socket member is formed from a resilient material in the form of a tapered molding comprising; a socket for accommodating an end of said leg, a base having a lower face which abuts against said upper surface of said foot member, and a waisted section of reduced cross section disposed between a bottom end of said socket and said lower face of said base, such that the stiffness of said socket member is reduced at said waisted section, and said connection means comprises a rod member spanning between said socket member and a first aperture in said foot member and tensioning means for tensioning said rod member so that in use said lower face of said base is clamped against said upper surface of said foot member.

2. A walking aid according to claim 1, wherein the amount of protrusion of said portion of said peripheral edge is at least 10 mm.

3. A walking aid according to claim 1, wherein said rod member has a head portion encapsulated in said socket member and a threaded portion protruding therefrom and extending through said first aperture, and said tensioning means comprises a threaded portion in said first aperture for threading onto said threaded portion of said rod member to tension said rod member and hold said socket member tightly against said foot member.

4. A walking aid according to claim 1, wherein said rod member has a head portion encapsulated in said socket member and a threaded portion protruding therefrom and extending through said first aperture, and said tensioning means comprises a nut for threading onto said threaded portion of said rod member to tension said rod member and hold said socket member tightly against said foot member.

5. A walking aid according to claim 4, wherein said foot member is provided with a guard ring formed on a lower surface thereof and surrounding said first aperture for protecting said nut.

6. A walking aid according to claim 5, wherein said foot member is of a generally rectangular shape in plan view, and said first aperture is disposed substantially centrally on said foot member, and there is further provided a second aperture disposed a predetermined distance in a longitudinal axis direction from said first aperture, for optionally accommodating said rod member when said walking aid is used for attachment to a leg of a crutch.

7. A walking aid according to claim 6, wherein said foot member is molded from a polymer material.

8. A walking stick or crutch fitted with a walking aid according to claim 1, fitted to a leg thereof.

9. A walking stick or crutch according to claim 8, wherein said leg of said walking stick or crutch comprises length adjusting means for adjusting the length thereof.

10. A walking stick or crutch according to claim 9, wherein said length adjusting means comprises a telescoping extension at a lower end thereof.

11. A walking stick or crutch according to claim 8, wherein a support on an end of said leg of said walking stick or crutch opposite from said walking aid end is formed so as to place said leg in line with the arm or armpit during use.

12. A walking stick or crutch according to claim 8, further comprising retrieval means operable from a handle of said walking stick or crutch against said foot member.

13. A walking stick or crutch according to claim 12, wherein operation of said retrieval means is by a linkage.

14. A walking stick or crutch according to claim 8, wherein a magnet is attached to said foot member, for use in retrieving metallic objects.

15. A walking aid for attachment to a leg of a walking stick or crutch, comprising a foot member having a peripheral edge defining a contact region for contact with the ground, and attachment means for attaching said foot member to said leg, said foot member and said attachment means being constructed and arranged such that in use with a leg attached to said foot member by said attachment means, a portion of said peripheral edge protrudes a sufficient amount to enable said leg when resting on the ground to be tilted to a substantially upright position by appropriate application of foot pressure to said portion of said peripheral edge, wherein said attachment means comprises a resilient spacer which separates said foot member from an end of said leg, a rod member adapted for connecting said foot member to the end of said leg, a first aperture formed in said foot member for accommodating said rod member, and tensioning means for optionally tensioning said rod member when fitted between said leg and said foot member, and said foot member is of a generally rectangular shape in plan view, and said first aperture is disposed substantially centrally on said foot member, and there is further provided a second aperture disposed a predetermined distance in a longitudinal axis direction from said first aperture, for optionally accommodating said rod member when said walking aid is used for attachment to a leg of a crutch.

* * * * *